US005826957A

United States Patent [19]

DeBartolo, Jr. et al.

[11] Patent Number: 5,826,957

[45] Date of Patent: Oct. 27, 1998

[54] HOUSING WITH MULTIPLE FIXED DECLINATION ADJUSTMENT POSITIONS AND LIVING HINGE CONNECTIONS

[75] Inventors: Joseph V. DeBartolo, Jr., North Stonington; John R. Baldwin, Newtown; Thomas J. Vigorito, Fairfield, all of Conn.

[73] Assignee: Hubbell Incorporated, Orange, Conn.

[21] Appl. No.: 805,710

[22] Filed: Feb. 25, 1997

[51] Int. Cl.[6] ..... A47F 5/08

[52] U.S. Cl. ..... 312/326; 312/248; 312/292; 292/DIG. 38; 220/476; 340/693

[58] Field of Search ..... 312/326, 327, 312/328, 329, 245, 248, 292, 138.1, 223.1; 220/476, 478, 339, 324; 16/225; 292/DIG. 38, DIG. 60, 300; 340/541, 693, 691

[56] References Cited

U.S. PATENT DOCUMENTS

| | | | |
|---|---|---|---|
| 3,451,580 | 6/1969 | Husby | 220/476 X |
| 3,504,787 | 4/1970 | Brockway | 220/476 X |
| 3,841,674 | 10/1974 | Bisbing et al. | 292/DIG. 38 X |
| 4,011,940 | 3/1977 | Neal et al. | 220/339 X |
| 4,066,306 | 1/1978 | Klinder | 312/245 X |
| 4,306,757 | 12/1981 | Horvay et al. | 312/248 X |
| 4,442,359 | 4/1984 | Lederer . | |
| 4,841,284 | 6/1989 | Bieksdorff . | |
| 4,876,445 | 10/1989 | McMaster . | |
| 4,876,970 | 10/1989 | Bolduc | 312/248 X |
| 5,499,016 | 3/1996 | Pantus | 340/693 X |
| 5,708,409 | 1/1998 | Schwimmer et al. | 340/541 X |

FOREIGN PATENT DOCUMENTS

| | | | |
|---|---|---|---|
| 38253 | 10/1981 | European Pat. Off. | 340/693 |
| 1440230 | 5/1969 | Germany | 312/245 |
| 3016930 | 11/1981 | Germany | 340/693 |
| 2122339 | 1/1984 | United Kingdom . | |

*Primary Examiner*—Jose V. Chen
*Assistant Examiner*—Hanh V. Tran
*Attorney, Agent, or Firm*—Jerry M. Presson; Michael R. Swartz

[57] ABSTRACT

A motion detection system housing includes a base having a back portion attachable to a wall, a cover having a front portion for mounting operative components of the detection system, a primary living hinge integrally connecting lower portions of the base and cover to one another such that the cover can undergo pivotal movement toward and away from the base between opened and closed conditions, and a latch releasably securing upper portions of the base and cover to one another. The cover and base have configurations that permit telescoping of the cover at least partially over the base into the closed condition. The latch can secure the cover to the base at different fixed telescoped positions with the front portion of the cover correspondingly disposed at different fixed declination adjustment positions relative to a reference plane. The latch includes a protuberance on the upper portion of the base and an elongated strap pivotally attached by an auxiliary living hinge to the upper portion of the cover and having apertures at different locations corresponding to the different fixed telescoped positions of the cover relative to the base and thus to the different possible fixed declination adjustment positions of the front portion of the cover relative to the reference plane. The strap is movable toward and away from the base between a released position where the protuberance is removed from all apertures and a secured position where the protuberance is interfitted with the one of the apertures corresponding to the selected one of the fixed declination adjustment positions.

24 Claims, 4 Drawing Sheets

HOUSING WITH MULTIPLE FIXED DECLINATION ADJUSTMENT POSITIONS AND LIVING HINGE CONNECTIONS

BACKGROUND OF THE INVENTION

1. Field of the Invention

The present invention generally relates to a wall mount detection system and, more particularly, is concerned with a housing for enclosing the components of the detection system, the housing incorporating parts that provide multiple fixed declination adjustment positions and living hinge connections.

2. Description of the Prior Art

A passive infrared motion detection system detects heat energy radiated or emitted by an object, such as the body of a person, moving across the field of view of a heat sensor, such as a pyroelectric detector, of the motion detection system. The motion detection system must be capable of distinguishing between background temperature and the moving object having a different temperature from the background. Thus, the detection system has an electrical circuit operatively coupled to the heat sensor for producing a detection signal in response to the heat sensor detecting a change of temperature as, for example, caused by the body heat of a person entering the detection pattern. The sensitive area of the heat sensor is too small to detect a significant amount of heat energy radiated from a human body by using the heat sensor alone. Thus, the detection system typically employs a lens made up of an array of Fresnel lens segments in a configuration for collecting and focusing a significantly greater amount of heat energy on the heat sensor than would be received using the heat sensor alone.

The configuration of a given lens is designed to provide an optical detection pattern that will generally match the shape of the area from which energy is to be collected by the lens. For example, the configuration of a lens to cover the area of a long narrow hallway in a building is substantially different from a lens to cover a relatively square or rectangular room in the building. However, even with the optical detection pattern of a given lens generally matched to the shape of the area, the declination of the lens may still need to be adjusted because of frequent variations in mounting heights and room configurations.

Heretofore, due to the design of the prior art housing of the motion detection system it has not been easy to perform adjustment of the angular declination of the lens. Typically, the housing is constructed of separate cover and base parts which must be assembled together using separate fasteners. Not only does this construction make difficult the adjustment of lens angular declination, it complicates the handling and assembling of the parts in the factory and the installation of the system in the field.

Consequently, a need exists for the design of a motion detection system housing that will overcome these drawbacks of the prior art housing without introducing any new drawbacks in their place.

SUMMARY OF THE INVENTION

The present invention provides a declination adjustable housing designed to satisfy the aforementioned needs. The housing of the present invention, although not so limited, is particularly suited to enclose components of a passive infrared motion detection system and includes parts that permit the adjustment of the housing to and the holding of the housing at selected ones of a multiple fixed angular declination positions in order to adjust the optical detection pattern of the motion detection system to a desired one of various mounting heights and room configurations. The housing of the present invention also includes parts having dual living hinge connections that permit quick and easy installation of the motion detection system and access to the detection system to make other appropriate internal adjustments thereto.

Accordingly, the present invention is directed to a housing for enclosing a motion detection system. The housing comprises: (a) a base having a pair of spaced opposite end portions and a back portion extending between the opposite end portions and adapted for attachment to a support surface; (b) a cover having a pair of spaced opposite end portions and a front portion extending between the opposite end portions, the cover and base having predetermined configurations that permit telescoping of the cover and base with one another into a closed condition; (c) primary hinge means for pivotally connecting one of the end portions of the cover to one of the end portions of the base such that the cover and base can undergo relative movement toward and away from one another between the closed condition and an opened condition wherein the cover and base are angularly displaced from one another; and (d) latch means for releasably securing the other of the end portions of the cover to the other of the end portions of the base so as to provide the cover and base in the closed condition at different fixed telescoped positions relative to one another with the front portion of the cover correspondingly disposed at different fixed declination adjustment positions relative to a reference plane. The primary hinge means is a living hinge extending between and integrally connected with the one end portions of the cover and base.

More particularly, the latch means includes a protuberance formed on and projecting outwardly from the other end portion of one of the base and cover, and an elongated strap having a pair of opposite ends and a plurality of apertures formed therein at different locations between opposite ends of the strap corresponding to the different possible fixed telescoped positions of the cover and base relative to one another and thus to the different fixed declination adjustment positions of the front portion of the cover relative to the reference plane. The latch means further includes auxiliary hinge means for connecting one of the ends of the strap to the other end portion of the other of the cover and base such that the strap can undergo pivotal movement toward and away from the other end portion of the one of the cover and base between a released position wherein the protuberance is removed from all of the apertures in the strap and a secured position wherein the protuberance is interfitted within the one of the apertures in the strap corresponding to a selected one of the different fixed declination adjustment positions of the front portion of the cover relative to the reference plane.

Furthermore, the auxiliary hinge means is a living hinge extending between and integrally connected with the one end of the strap and the other end portion of the other of the cover and base. The relative sizes and configurations of the base and cover permit telescoping of the cover at least partially over the base with the base extending at least partially within the cover.

Also, the housing comprises an annular mating lip defined on the front portion of the cover surrounding an opening therein, and a closure having an annular insert frame interfitted with the lip and seated on the front portion of the cover through the opening therein, a door and means for pivotally attaching the door to the insert frame. The insert frame has one rim portion with first interengaging elements defined thereon and a bottom with holes therein for extending control elements of a motion detection system mounted on an interior side of the front portion of the cover into the insert frame. The door has one edge with second interengaging elements defined thereon that are releasably latchable with the first interengaging elements on the one rim portion of the insert frame. The attaching means is a living hinge that integrally pivotally connects another edge of the door being opposite from the one edge thereof to another rim portion of the insert frame being opposite from the one rim portion thereof such that the door can undergo movement toward and away from the insert frame between latched and unlatched position to respectively prevent and provide access to make internal adjustments on an interior side of the front portion of the cover.

These and other features and advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description reference will be made to the attached drawings in which.

DETAILED DESCRIPTION OF THE INVENTION

Figure 2:
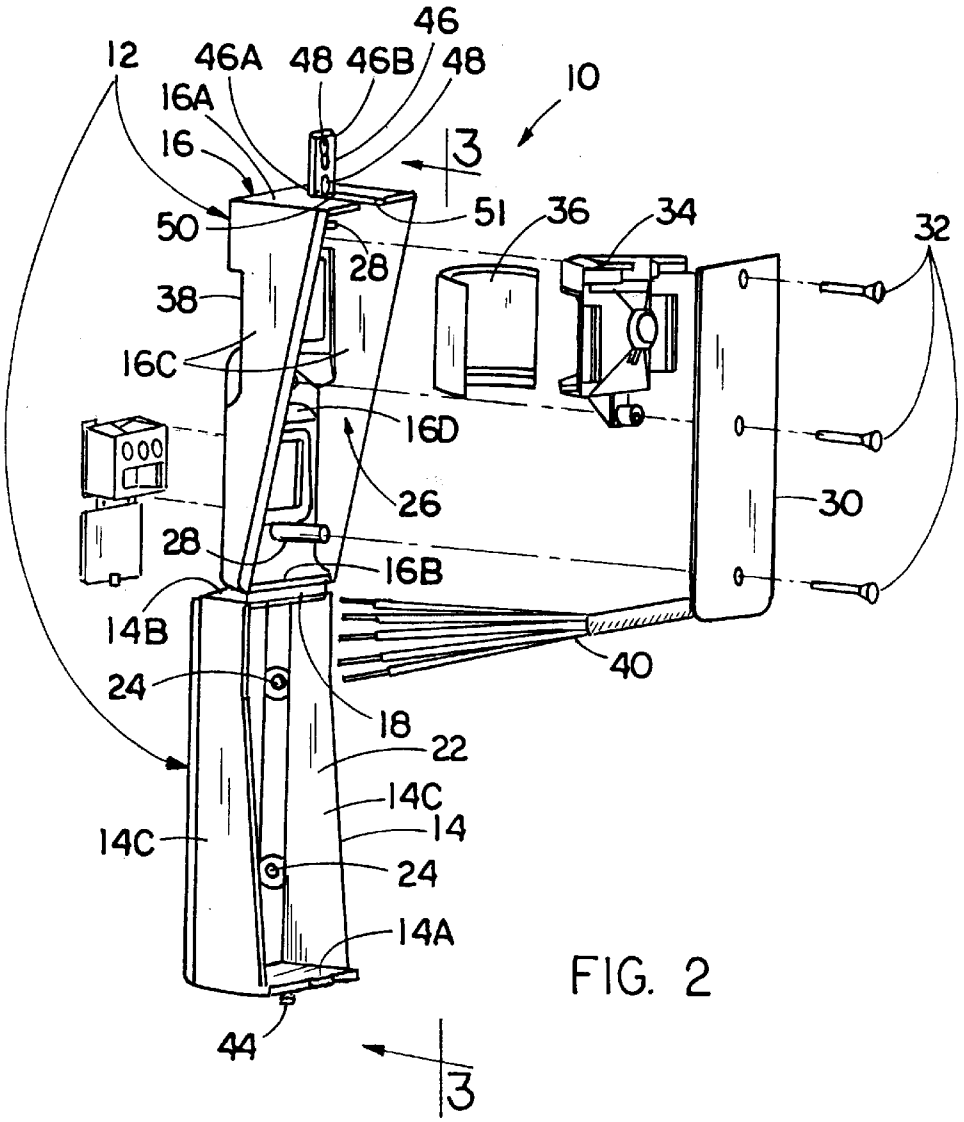
FIG. 2 is a rear perspective view of the motion detection system showing the housing and the components of the motion detection system in exploded form.
Figure 1:
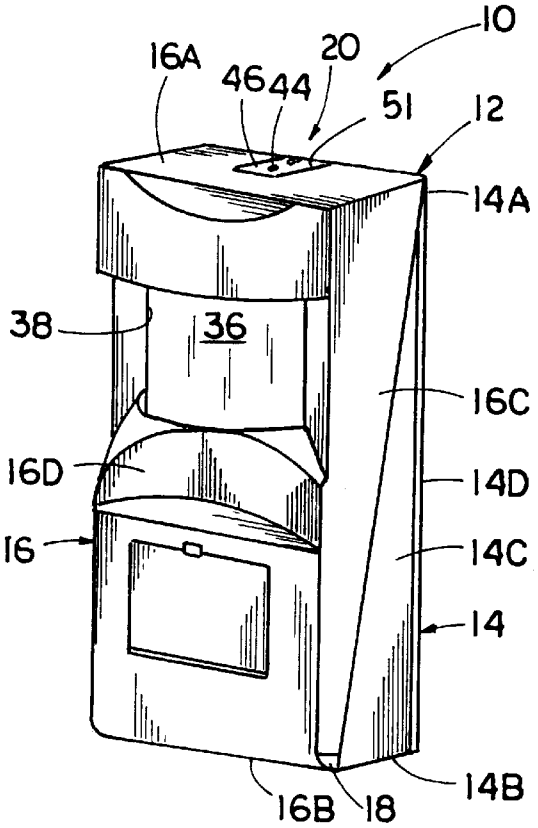
FIG. 1 is a front perspective view of a motion detection system employing a declination adjustable housing of the present invention which encloses components of the motion detection system.
Figure 3:
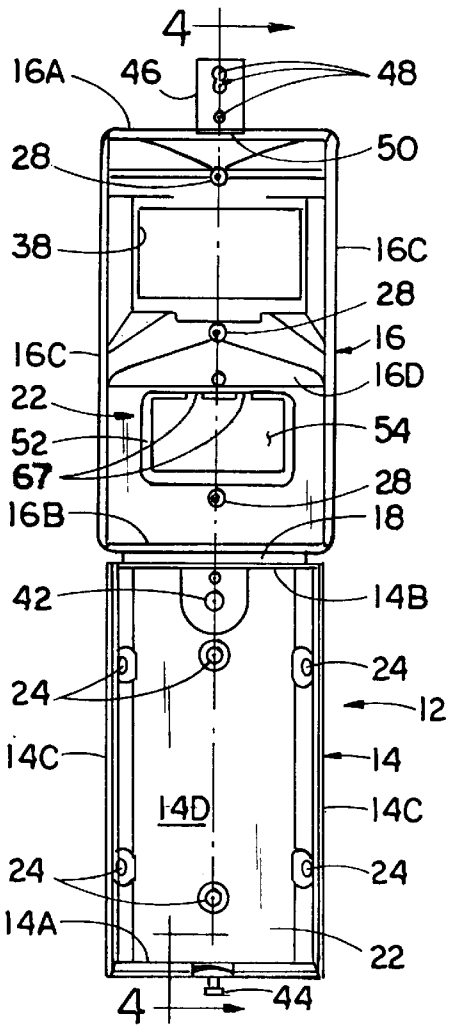
FIG. 3 is an interior plan view of the housing as seen along line 3—3 of FIG. 2.
Figure 4:
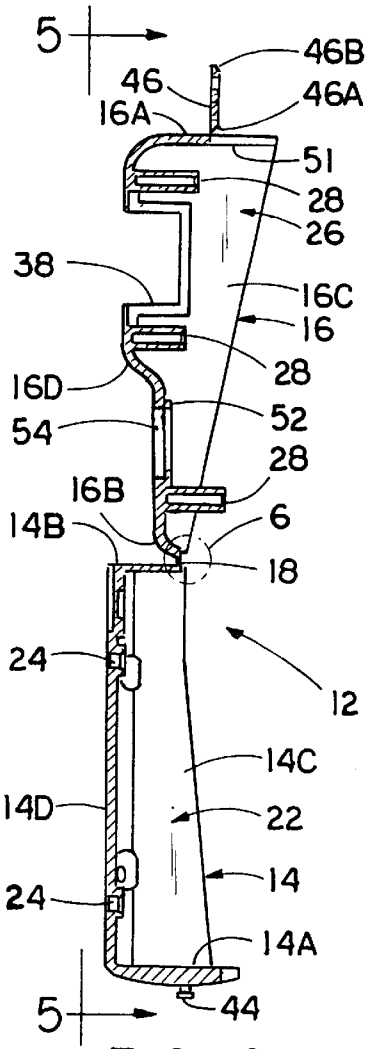
FIG. 4 is a longitudinal sectional view of the housing taken along line 4—4 of FIG. 3.
Figure 5:
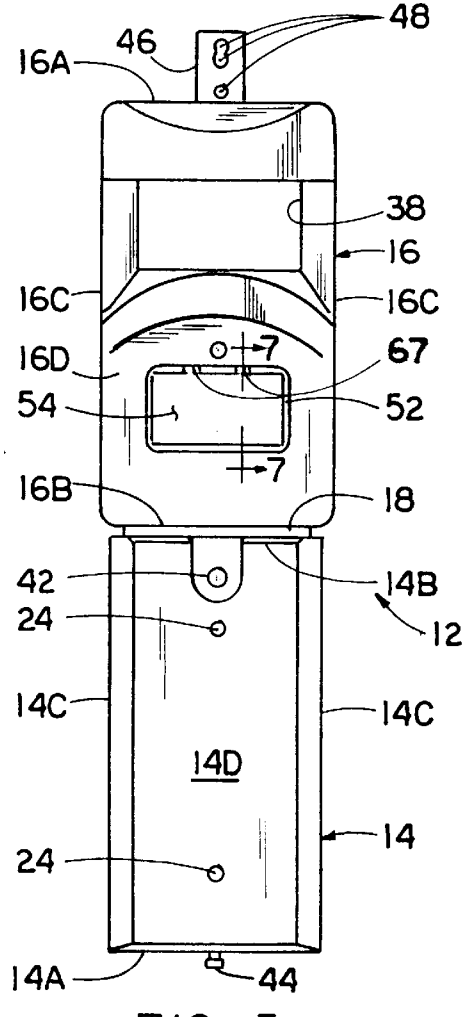
FIG. 5 is an exterior plan view of the housing as seen along line 5—5 of FIG. 4.
Figure 6:
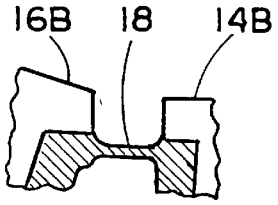
FIG. 6 is an enlarged detailed view of the portion of the housing enclosed by circle 6 in FIG. 4 showing a living hinge connection between a cover and a base of the housing.
Figure 7:
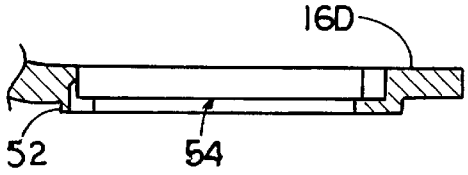
FIG. 7 is an enlarged sectional view of an annular lip defined in the cover of the housing for receiving a closure.
Figure 9:
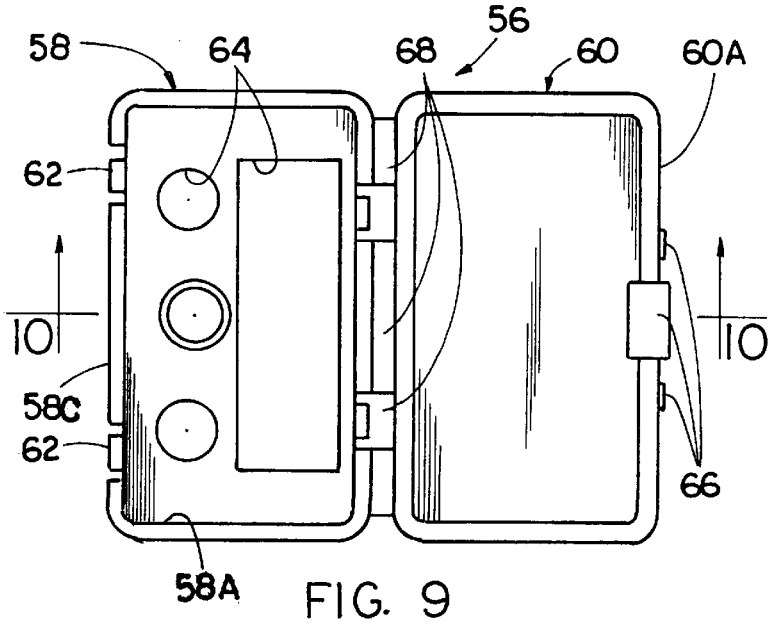
FIG. 9 is an enlarged front elevational view of the closure of FIG. 8.
Figure 10:
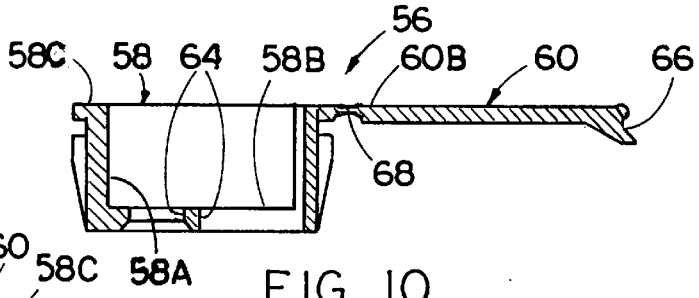
FIG. 10 is a cross-sectional view of the closure taken along line 10—10 of FIG. 9.
Figure 8:
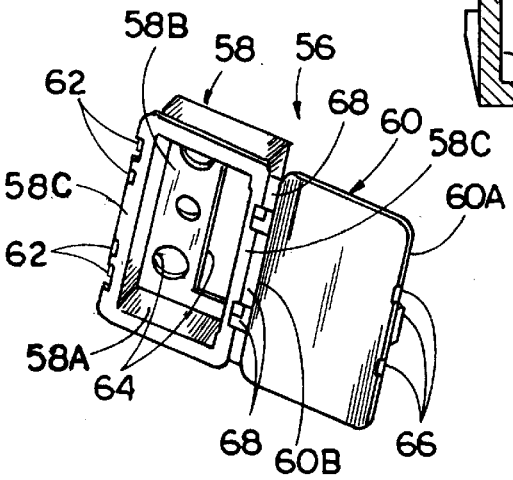
FIG. 8 is an enlarged front perspective view of the closure removed from the cover of the housing.

In the following description, like reference characters designate like or corresponding parts throughout the several views. Also in the following description, it is to be understood that such terms as "forward", "rearward", "left", "right", "upwardly", "downwardly", and the like, are words of convenience and are not to be construed as limiting terms.

Referring now to the drawings, and particularly to FIGS. 1–6, there is illustrated a passive infrared motion detection system, generally designated 10, employing a declination adjustable housing 12 of the present invention which encloses operative components of the motion detection system 10. The housing 12 basically includes a base 14, a cover 16, primary hinge means 18 and latch means 20. Preferably, the housing 12 is fabricated from any suitable plastic material using conventional injection molding techniques.

The base 14 of the housing 12 has spaced apart opposite upper and lower end portions 14A, 14B, spaced apart opposite side portions 14C attached to and extending between the upper and lower end portions 14A, 14B, and a back portion 14D attached to and extending between the upper and lower end portions 14A, 14B and side portions 14C such that together they form a rear cavity 22 in the base 14 being open at the front of the base 14. The back portion 14D of the base 14 has a plurality of holes 24 defined therethrough for receiving conventional fasteners (not shown) that can be secured to a support surface S (see FIGS. 11–14).

The cover 16 of the housing 12 has spaced apart opposite top and bottom end portions 16A, 16B, spaced apart opposite side portions 16C attached to and extending between the top and bottom end portions 16A, 16B, and a front portion 16D attached to and extending between the top and bottom end portions 16A, 16B such that together they form a front cavity 26 in the cover 16 being open at the rear of the cover 16. The cover 16 also has several support pedestals 28 fixedly and integrally attached on and projecting rearwardly from an interior side of the front portion 16D of the cover 16 for mounting a printed circuit board assembly 30 of the motion detection system 10 by employing screws 32. The printed circuit board assembly 30 mounts other components of the motion detection system 10 which include a lens retainer 34 supporting a lens 36 of the motion detection system 10 within a window 38 formed in the front portion 16D of the cover 16. Also, a plurality of wires 40 are connected with the printed circuit board assembly 30 for routing from the housing 12 through an opening 42 formed in the lower end portion 14B of the base 14 of the housing 12.

Figure 11:
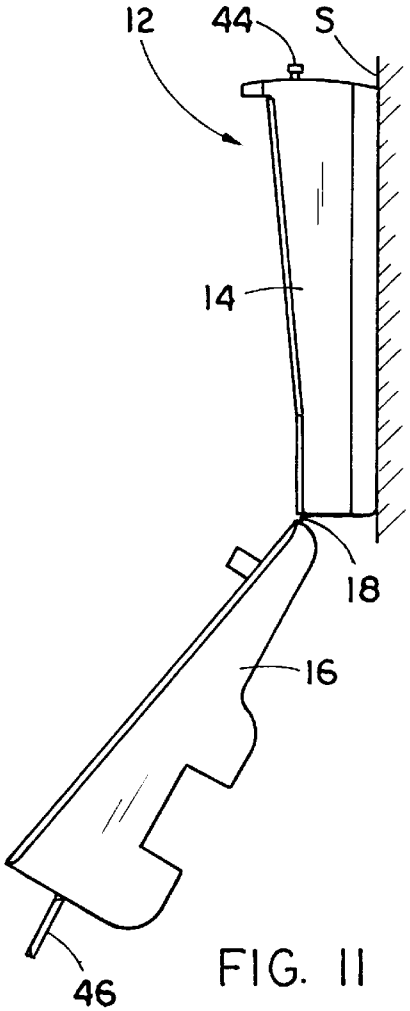
FIG. 11 is a side elevational view of the housing showing its cover in an opened condition relative to its base.

The primary hinge means 18 of the housing 12 is preferably a living hinge 18 that integrally and pivotally connects the bottom end portion 16B of the cover 16 to the lower end portion 14B of the base 14 such that the cover 16 and base 14 can undergo relative movement toward and away from one another between a closed condition, as seen in FIGS. 1 and 12–14 and an opened condition, as seen in FIG. 11. In the opened condition the base 14 and cover 16 are angularly displaced from one another. Also, the base 14 and cover 16 have predetermined relative sizes and configurations that permit telescoping of the cover and base with one another from the opened position of FIG. 11, into the closed position of FIGS. 1 and 12–14. In the exemplary embodiment shown in FIGS. 1 and 11–14, the cover 16 is larger in size than the base 14 so as to permit telescoping of the cover 16 at least partially over the base 14 with the base 14 thus extending at least partially within the front cavity 26 of the cover 16. Specifically, the top end portion 16A and side portions 16C of the cover 16 in the closed condition partially overlie the upper end portion 14A and side portions 14C of the base 14. However, the opposite could be the case wherein a larger size base could be capable of at least partially telescoping over a smaller size cover 16 such that the cover 16 would extend at least partially within the rear cavity 22 of the base 14.

Figure 14:
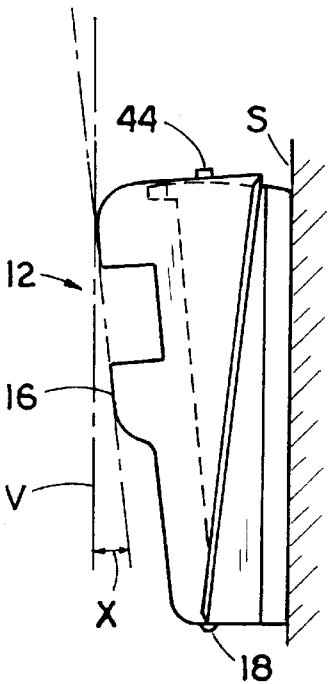
FIG. 14 is still another side elevational view of the housing similar to that of FIG. 12 but showing the cover at a minimum fixed declination adjustment position relative to the vertical reference plane.
Figure 13:
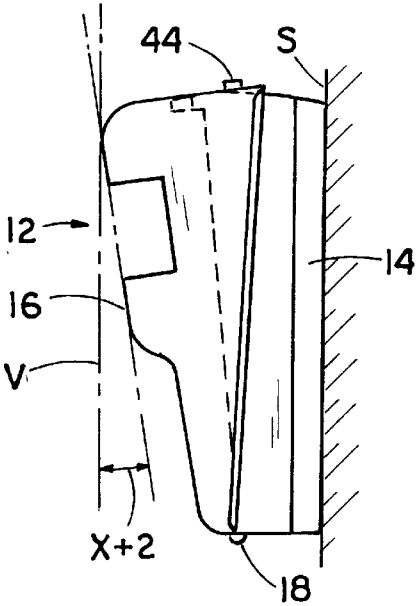
FIG. 13 is another side elevational view of the housing similar to that of FIG. 12 but showing the cover of the housing at an intermediate fixed declination adjustment position relative to the vertical reference plane.
Figure 12:
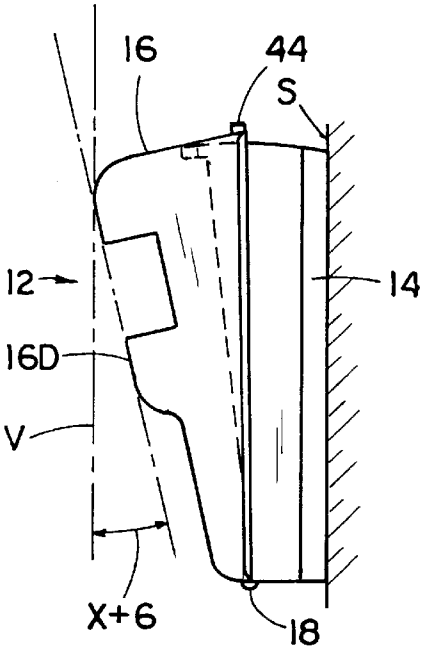
FIG. 12 is a side elevational view of the housing showing its cover in a closed condition relative to its base with the cover of the housing at a maximum fixed declination adjustment position relative to a vertical reference plane.

Referring to FIGS. 2–5 and 11–14, the latch means 20 of the housing 12 functions to releasably secure the top end portion 16A of the cover 16 to the upper end portion 14A of the base 14 so as to allow the cover 16 and base 14 to be placed in the closed condition at different fixed telescoped positions relative to one another (three of which positions are shown as examples in FIGS. 12–14) with the front portion 16D of the cover 16 correspondingly disposed at different fixed declination adjustment positions relative to a reference plane, such as represented by the vertical reference plane V in FIGS. 12–14. Preferably, the latch means 20 includes a protuberance 44 formed on and projecting outwardly from the upper end portion 14A of the base 14 and an elongated strap 46 having opposite inner and outer ends 46A, 46B and a plurality of apertures 48 formed through the strap 46 at different locations between its opposite ends 46A, 46B which correspond to the different possible fixed telescoped positions of the cover 16 and base 14 relative to one another and thus to the different fixed declination adjustment positions of the front portion 16D of the cover 16 relative to the reference plane, such as the vertical support surface S. The latch means 20 further includes auxiliary hinge means 50 in the form of a living hinge 50 integrally and pivotally connecting the inner end 46A of the strap 46 to the top end portion 16A of the cover 16 such that the strap 46 can undergo pivotal movement toward and away from the upper end portion 14A of the base 14 between a released position, as seen in FIGS. 2–5 and 11, wherein the protuberance 44 is removed from all of the apertures 48 in the strap 46 and a secured position, as seen in FIGS. 1 and 12–14, wherein the protuberance 44 is interfitted within the one of the apertures 48 in the strap 46 corresponding to a selected one of the different fixed declination adjustment positions of the front portion 16D of the cover 16 relative to the vertical reference plane V. Preferably, the protuberance 44 is shaped to be releasably snap fittable with each of the apertures 48 in the strap 46. The top end portion 16A of the cover 16 has a slot 51 to accommodate the presence of the protuberance 44 and strap 46 in the secured position of the latch means 20. Also, the locations of the protuberance 44 and strap 46 respectively on the base 14 and cover 16 could be reversed within the purview of the present invention in the case where the base 14 extends over the cover 16.

Referring to FIGS. 11–14, there are illustrated some examples of different relative positions that can be assumed by the base 14 and cover 16 of the housing 12 where the strap is provided with three apertures 48. In FIG. 11, the cover 16 is shown in an opened condition relative to the base 14. In FIG. 12, the cover 16 is shown in a closed condition relative to the base 14 wherein the cover 16 is disposed at a maximum fixed declination adjustment position relative to the vertical reference plane V. In FIG. 13, the cover 16 is also shown in the closed condition relative to the base 14 but with the cover 16 now at an intermediate fixed declination adjustment position relative to the vertical reference plane V. In FIG. 14, the cover 16 is also shown in the closed condition relative to the base 14 but now at a minimum fixed declination adjustment position relative to the vertical reference plane V. By way of example, suppose the front portion 16D of the cover 16 is disposed at an angle X° relative to the reference line V at the minimum fixed declination adjustment position of FIG. 14. Then, in FIGS. 13 and 12 where the cover 16 is disposed respectively at the intermediate and maximum fixed declination adjustment positions, the angles might be (X+2)° and (X+6)°, respectively. In the minimum position the range of the motion detection system might be, for example, seventy-five feet, while in the intermediate and maximum positions the range might be thirty-six and eighteen feet, respectively.

Referring to FIGS. 1–5 and 7–10, the housing 12 also has an annular mating lip 52 defined on the front portion 16D of the cover 16 surrounding an opening 54 therein spaced below the window 38, and a closure 56 separate from the base 14 and cover 16 of the housing 12. The closure 56 has an annular insert frame 58 interfitted with the annular mating lip 52 and seated on the front portion 16D of the cover 16 through the opening 54 therein, a door 60 and means for pivotally attaching the door 60 to the insert frame 58. The insert frame 58 of the closure 56 includes a continuous sidewall 58A interconnected by a bottom wall 58B and a top marginal rim 58C. First interengaging elements 62 are defined on the sidewall 58A for latchable engagement with the annular mating lip 52 of cover 16. The bottom wall 58B has holes 64 defined therein for making internal adjustments on an interior side of the front portion 16D of the cover 16. The door 60 of the closure 56 has one edge 60A with second interengaging elements 66 defined thereon that are releasably latchable with corresponding cutouts 67 provided on one side of the annular mating lip 52 of cover 16. The attaching means preferably is a living hinge 68 that integrally pivotally connects another edge 60B of the door 60, being opposite from the one edge 60A thereof, to the marginal rim 58C of the insert frame 58 such that the door 60 can undergo movement toward and away from the insert frame 58 between latched and unlatched positions, respectively seen in FIGS. 1 and FIGS. 8–10, to respectively prevent and provide access to the interior side of the front portion 16D of the cover 16.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the forms hereinbefore described being merely preferred or exemplary embodiments thereof.

We claim:

1. A housing for enclosing operative components of a motion detection system, said housing comprising:

(a) a base having a pair of spaced opposite end portions and a back portion extending between said opposite end portions and adapted for attachment to a support surface;

(b) a cover having a pair of spaced opposite end portions and a front portion extending between said opposite end portions, said cover and base having predetermined configurations that permit telescoping of said cover and base with one another into a closed condition;

(c) primary hinge means for pivotally connecting one of said end portions of said cover to one of said end portions of said base such that said cover and base can undergo relative movement toward and away from one another between said closed condition and an opened condition wherein said cover and base are angularly displaced from one another; and (d) latch means for releasably securing the other of said end portions of said cover to the other of said end portions of said base so as to provide said cover and base in said closed condition at different fixed telescoped positions relative to one another with said front portion of said cover correspondingly disposed at different fixed declination adjustment positions relative to a reference plane, said latch means including (i) a protuberance formed on and projecting outwardly from said other end portion of one of said base and cover; and (ii) an elongated strap having a pair of opposite ends and a plurality of apertures formed in said strap at different locations between said opposite ends of said strap corresponding to said different fixed telescoped positions of said cover and base relative to one another and thus to said different fixed declination adjustment portions of said front portion of said cover relative to said reference plane.

2. The housing as recited in claim 1, wherein said primary hinge means is a living hinge extending between and integrally connected with said one end portions of said cover and base.

3. The housing as recited in claim 1, wherein said latch means further includes auxiliary hinge means for connecting one of said ends of said strap to said other end portion of the other of said cover and base such that said strap can undergo pivotal movement toward and away from said other end portion of said one of said cover and base between a released position wherein said protuberance is removed from all of said apertures in said strap and a secured position wherein said protuberance is interfitted within the one of said apertures in said strap corresponding to a selected one of said different fixed declination adjustment positions of said front portion of said cover relative to said reference plane.

4. The housing as recited in claim 3, wherein said protuberance is releasably snap fittable with each of said apertures in said strap.

5. The housing as recited in claim 3, wherein said auxiliary hinge means is a living hinge extending between and integrally connected with said one end of said strap and said other end portion of said other of said cover and base.

6. The housing as recited in claim 1, wherein said relative predetermined configurations of said cover and base permit telescoping of said cover at least partially over said base with said base extending at least partially within said cover.

7. The housing as recited in claim 1, further comprising:

a plurality of pedestals attached on and projecting from an interior side of said front portion of said cover to provide for mounting components of a motion detection system to said cover.

8. A housing for enclosing operative components of a motion detection system, said housing comprising:

(a) a base having a pair of spaced opposite end portions and a back portion extending between said opposite end portions and adapted for attachment to a support surface;

(b) a cover having a pair of spaced opposite end portions and a front portion extending between said opposite end portions, said cover and base having predetermined configurations that permit telescoping of said cover and base with one another into a closed condition;

(c) primary hinge means for pivotally connecting one of said end portions of said cover to one of said end portions of said base such that said cover and base can undergo relative movement toward and away from one another between said closed condition and an opened condition wherein said cover and base are angularly displaced from one another;

(d) latch means for releasably securing the other of said end portions of said cover to the other of said end portions of said base so as to provide said cover and base in said closed condition at different fixed telescoped positions relative to one another with said front portion of said cover correspondingly disposed at different fixed declination adjustment positions relative to a reference plane;

(e) an annular mating lip defined on said front portion of said cover surrounding an opening therein; and (f) a closure including (i) an annular insert frame interfitted with said annular mating lip and seated within said front portion of said cover through said opening therein, said insert frame having first interengaging elements defined thereon for latachable connection with said annular mating lip, (ii) a door having one edge with second interengaging elements defined thereon releasably latchable with said annular mating lip, and (iii) means for pivotally attaching another edge of said door being opposite from said one edge thereof to a marginal rim of said insert frame such that said door can undergo movement toward and away from said insert frame between said latched and unlatched positions to respectively prevent and provide access to an interior side of said front portion of said cover.

9. The housing as recited in claim 8, wherein said insert frame also having a bottom wall with holes defined therein for making adjustments on said interior side of said front portion of said cover.

10. The housing as recited in claim 8, wherein said attaching means is a living hinge extending between and integrally connected with said another edge of said door and said marginal rim of said insert frame.

11. A housing for a motion detection system, comprising:

(a) a base having a back portion attachable to a wall;

(b) a cover having a front portion for mounting operative components of a motion detection system;

(c) a primary living hinge integrally connecting lower portions of said base and cover to one another such that said cover can undergo pivotal movement toward and away from said base between opened and closed conditions, said cover and base having configurations that permit telescoping of said cover with said base into said closed condition; and (d) a latch releasably securing upper portions of said base and cover to one another, said latch being adapted to secure said cover to said base in said closed condition at different fixed telescoped positions with said front portion of said cover correspondingly disposed at different fixed declination adjustment positions relative to a reference plane, said latch means including (i) a protuberance on said upper portion of said base;

(ii) elongated strap; and (iii) an auxiliary living hinge pivotally attached to said upper portion of said cover and having apertures at different locations corresponding to said different fixed telescoped positions of said cover relative to said base and thus to the different possible fixed declination adjustment positions of said front portion of said cover relative to the reference plane;

said strap being movable toward and away from said base between a released position wherein said protuberance is removed from all apertures and a secured position wherein said protuberance is interfitted with the one of said apertures corresponding to the selected one of said fixed declination adjustment positions of said front portion of said cover relative to the reference plane.

12. The housing as recited in claim 11, further comprising:

a plurality of pedestals attached on and projecting from an interior side of said front portion of said cover to provide for mounting components of a motion detection system to said cover.

13. A housing for enclosing operative components of a motion detection system, said housing comprising:

(a) a base having a pair of spaced opposite end portions and a back portion extending between said opposite end portions and having means for attaching said base at said back portion to a support surface;

(b) a cover having a pair of spaced opposite end portions and a front portion extending between said opposite end portions, said cover having means on an interior side of said front portion of said cover for mounting components of a motion detection system to said cover;

(c) a living hinge integrally and pivotally connecting one of said end portions of said cover to one of said end portions of said base such that said cover and base can undergo relative movement toward and away from one another between a closed condition and an opened condition wherein said cover and base are angularly displaced from one another; and (d) latch means for releasably securing the other of said end portions of said cover to the other of said end portions of said base so as to hold said cover and base at said closed condition.

14. The housing as recited in claim 13, wherein said attaching means on said base at said back portion thereof are a plurality of holes through said back portion of said base.

15. The housing as recited in claim 13, wherein said mounting means on said interior side of said front portion of said cover is a plurality of pedestals attached on and projecting from said interior side of said front portion of said cover.

16. A housing for enclosing operative components of a motion detection system, said housing comprising:

(a) a base having a pair of spaced opposite end portions and a back portion extending between said opposite end portions and adapted for attachment to a support surface;

(b) a cover having a pair of spaced opposite end portions and a front portion extending between said opposite end portions, said front portion having an annular mating lip defined thereon surrounding an opening therein;

(c) hinge means for pivotally connecting one of said end portions of said cover to one of said end portions of said base such that said cover and base can undergo relative movement toward and away from one another between a closed condition and an opened condition wherein said cover and base are angularly displaced from one another;

(d) latch means for releasably securing the other of said end portions of said cover to the other of said end portions of said base so as to hold said cover and base at said closed condition; and (e) a closure mounted to said cover, said closure including (i) an annular insert frame interfitted with said annular mating lip and seated within said front portion of said cover through said opening therein, (ii) a door having one edge releasably latchable with said annular mating lip, and (iii) means for pivotally attaching another edge of said door being opposite from said one edge thereof to said insert frame such that said door can undergo movement toward and away from said insert frame between said latched and unlatched positions to respectively prevent and provide access to an interior side of said front portion of said cover.

17. The housing as recited in claim 16, wherein said insert frame also has a bottom wall with holes defined therein for making adjustments on said interior side of said front portion of said cover.

18. The housing as recited in claim 16, wherein said attaching means is a living hinge extending between and integrally connected with said another edge of said door and said insert frame.

19. The housing as recited in claim 16, wherein said primary hinge means is a living hinge extending between and integrally connected with said one end portions of said cover and base.

20. The housing as recited in claim 16, wherein said latch means includes a protuberance formed on and projecting outwardly from said other end portion of one of said base and cover.

21. The housing as recited in claim 20, wherein said latch means further includes an elongated strap having a pair of opposite ends and a plurality of apertures formed in said strap at different locations between said opposite ends of said strap corresponding to said different fixed telescoped positions of said cover and base relative to one another and thus to said different fixed declination adjustment positions of said front portion of said cover relative to said reference plane.

22. The housing as recited in claim 21, wherein said latch means further includes auxiliary hinge means for connecting one of said ends of said strap to said other end portion of the other of said cover and base such that said strap can undergo pivotal movement toward and away from said other end portion of said one of said cover and base between a released position wherein said protuberance is removed from all of said apertures in said strap and a secured position wherein said protuberance is interfitted within the one of said apertures in said strap corresponding to a selected one of said different fixed declination adjustment positions of said front portion of said cover relative to said reference plane.

23. The housing as recited in claim 22, wherein said protuberance is releasably snap fittable with each of said apertures in said strap.

24. The housing as recited in claim 22, wherein said auxiliary hinge means is a living hinge extending between and integrally connected with said one end of said strap and said other end portion of said other of said cover and base.

* * * * *